US005092487A

United States Patent [19]

Richer et al.

[11] Patent Number: 5,092,487

[45] Date of Patent: Mar. 3, 1992

[54] RECEPTACLE, HOLDER THEREFOR AND COMBINATION THEREOF

[76] Inventors: André Richer, 7659 André Merlot, Lasalle, Quebec, Canada, H8N 2G5; Robert Katz, 4710 St-Ambroise, Suite 225, Montreal, Quebec, Canada, H4C 2C7; Jean-Pierre Lefebvre, 7659 André Merlot, Lasalle, Quebec, Canada, H8N 2G5

[21] Appl. No.: 676,532

[22] Filed: Mar. 28, 1991

[51] Int. Cl.[5] ..... B65D 25/24

[52] U.S. Cl. ..... 220/482; 248/215; 248/304

[58] Field of Search ..... 220/476, 477, 480, 481, 220/482; 248/251, 215, 294, 301, 303, 307, 318, 304

[56] References Cited

U.S. PATENT DOCUMENTS

| | | | |
|---|---|---|---|
| 1,072,022 | 9/1913 | Miller . | |
| 2,356,473 | 8/1944 | Saul, Jr. | 220/482 |
| 2,432,206 | 12/1947 | Mott . | |
| 2,550,019 | 4/1951 | Murphy . | |
| 2,592,752 | 5/1952 | Batts | 220/482 |
| 2,724,881 | 11/1955 | Di Maria . | |
| 2,908,396 | 10/1959 | Odlozil . | |
| 2,938,695 | 5/1960 | Ciampa . | |
| 3,007,664 | 11/1961 | Fairbanks et al. . | |
| 3,016,149 | 1/1962 | Dean . | |
| 3,190,500 | 6/1965 | Miles | 220/482 |
| 3,432,061 | 3/1969 | Anderson | 220/481 |
| 3,881,677 | 5/1975 | Ihlenfeld . | |
| 3,892,315 | 7/1975 | Johnson . | |
| 3,980,202 | 9/1976 | Monyak et al. . | |
| 4,247,070 | 1/1981 | Dirksing . | |
| 4,436,269 | 3/1984 | Dirksing et al. . | |
| 4,455,692 | 6/1984 | Hegge et al. . | |
| 4,643,380 | 2/1987 | Copeland . | |

FOREIGN PATENT DOCUMENTS 375741 3/1932 United Kingdom .

*Primary Examiner*—Joseph Man-Fu Moy

*Attorney, Agent, or Firm*—Swabey Ogilvy Renault

[57] ABSTRACT

A receptacle comprises an upright container having a rear portion formed with a pair of slides and a cover hingedly operably at the top to open at least rearwardly therefrom. A holder comprises a rectangular member, outwardly projecting flanges formed along lateral edges of the rectangular member, a top plate extending at least partly at the upper edge of the rectangular member and projecting outwardly therefrom substantially at right angle, a base plate extending at least partly along the bottom edge of the rectangular member and projecting inwardly therefrom substantially at right angle, horizontal slots formed in the rectangular member and arranged to provide at least one column of vertically distributed spaced slots, a plurality of locking devices provided in the front face of the rectangular member each distributed opposite and in the front face of the vicinity of the slots, and at least one strap provided with an arrester at an inner end thereof and having a plurality of engagement with the locking devices. The engagement are distributed toward the outer end of the strap, the strap extending through an uppermost slot while being held by the arrester, over the horizontal support, and a selected engagement hooked over the locking devices to retain the holder against the horizontal support. To mount the combination, the holder is fixed to the support by the strap and the receptacle is affixed to the holder by engaging the slides over the flanges.

7 Claims, 3 Drawing Sheets

RECEPTACLE, HOLDER THEREFOR AND COMBINATION THEREOF

BACKGROUND OF THE INVENTION

1. Field of the Invention

This invention relates to the combination of a receptacle and a holder for the receptacle, this combination to be mounted on a horizontal support and also capable of being fixed against a vertical wall. The combination is particularly suitable for use with any kind of receptacles, such as garbage pails which can be placed on the outside of the railing of a veranda or alternately inside a storage area such as a garage. The invention also relates to the holder and the receptacle per se.

2. Description of the Prior Art

A combination including a receptacle and a holder therefor is described in U.S. Pat. No. 4,974,803 issued Dec. 4, 1990. However, it has been found that the arrangement described therein is somewhat awkward and complicated to manufacture and install. Furthermore, the cost involved in providing the attachment for fixing the holder to a handrail, would prohibit the manufacture of such a device for mass production.

Other devices are known, but none is believed to be completely satisfactory. Reference is made to the following U.S. Pat. Nos.:

| | |
|---|---|
| 1,072,022 | 3,016,149 |
| 2,432,206 | 3,881,677 |
| 2,550,019 | 3,892,315 |
| 2,724,881 | 3,980,202 |
| 2,908,396 | 4,247,070 |
| 2,938,695 | 4,436,269 |
| 3,007,664 | 4,455,692 |
| | 4,643,380 |

Reference is also made to British Patent No. 375741.

SUMMARY OF THE INVENTION

It is an object of the present invention to provide a combination holder and receptacle which overcomes the difficulties and disadvantages associated with the devices of the prior art.

This and other objects of the present invention may be achieved by providing a combination of a receptacle and a holder for said receptacle, said combination to be mounted on a horizontal support and also capable of being fixed against a vertical wall, said receptacle comprising an upright container having a rear portion formed with a pair of slide means, and a cover open at least rearwardly therefrom, said holder comprising a rectangular member, outwardly projecting flange means formed along lateral edges of said rectangular member, a top plate extending at least partly at upper edge of said rectangular member and projecting outwardly therefrom substantially at right angle, a base plate extending at least partly along bottom edge of said rectangular member and projecting inwardly therefrom substantially at right angle, a plurality of horizontal slots formed in said rectangular member and arranged to provide at least one column of vertically distributed spaced slots, a plurality of locking means provided in front face of said rectangular members each distributed opposite and in vicinity of said slots, at least one strap provided with an arrester at an inner end thereof and having a plurality of means engageable with said locking means, said engageable means distributed toward outer end of said strap, said strap to extend through an uppermost slot while being held by said arrester, to extend over said horizontal support and a selected engageable means hooked over said locking means to retain said holder against said horizontal support, so that to mount said combination, said holder is fixed to said support by means of said strap, and said receptacle is affixed to said holder by engaging said sliding means over said flange means.

BRIEF DESCRIPTION OF THE DRAWINGS

The invention is illustrated but not restricted by means of the annexed drawings in which.

DESCRIPTION OF THE PREFERRED EMBODIMENTS

Figure 1:
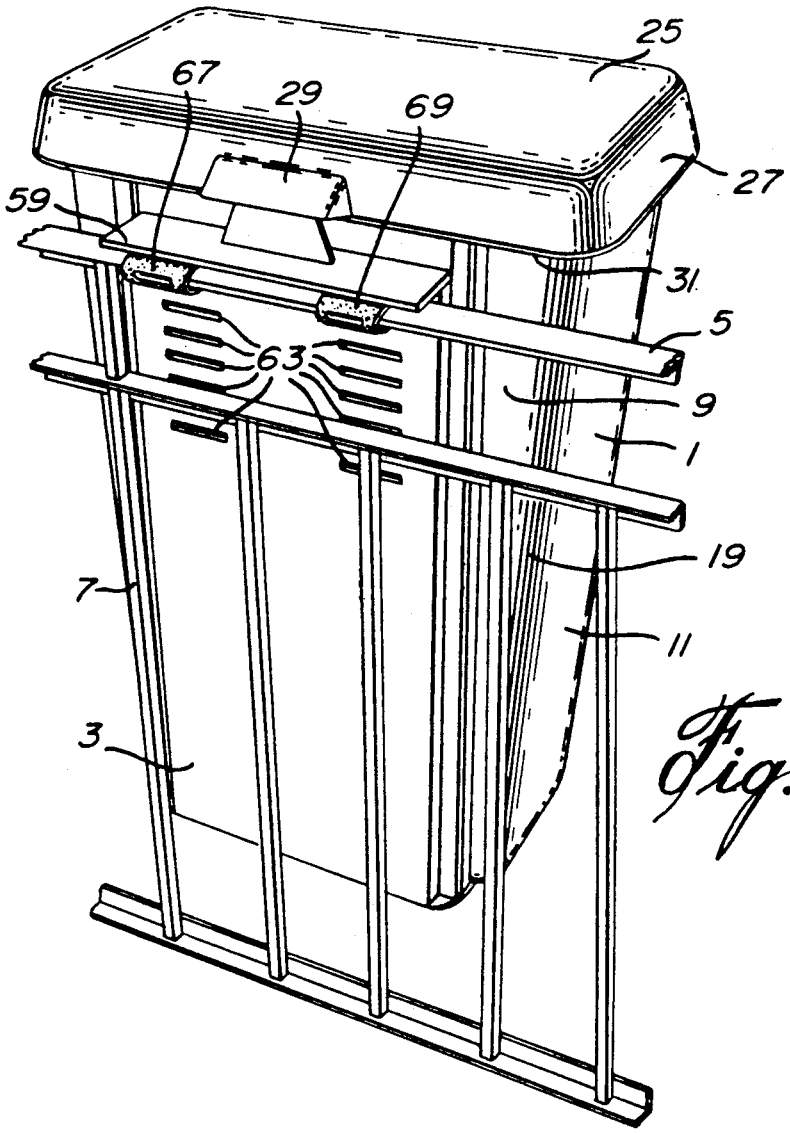
FIG. 1 is a perspective view of a combination according to the invention is position when mounted over
Figure 6:
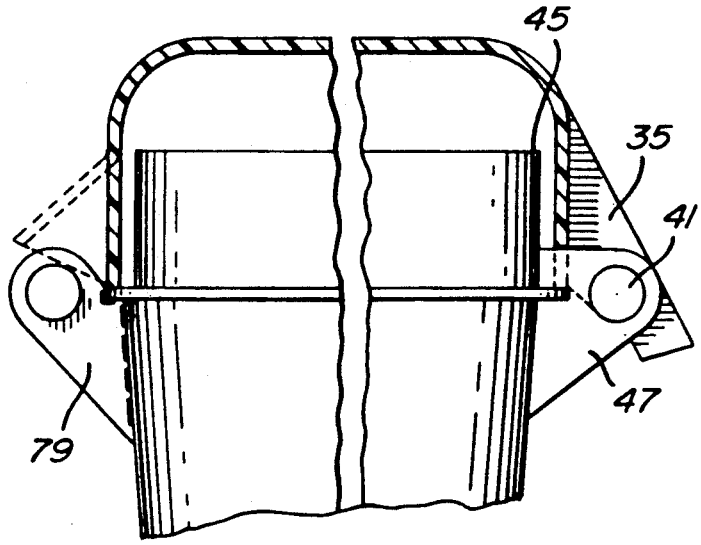
FIG. 6 is a side view partly cut away and partly in cross-section showing the reversibility of the cover for mounting the combination over a handrail or against a vertical wall.

With reference to the drawings it will be seen that the combination comprises a receptacle in the form of an upright container 1 and a holder 3 for the container. The combination is adapted for mounting over the handrail 5 of the fence 7 of a veranda (not shown).

The upright container 1 has a flat vertical rear wall 9, and upwardly flaring side walls 11 and 13 and front wall 15. For design purpose and appearance the four corners 17, 19, 21 and 23 are rounded. The upright container 1 is closed by means of a cover 25 which can be opened by means of a hinging mechanism which will be described later. As shown, cover 25 consists of a rectangular plate member and a peripheral downwardly extending flange 27 which surrounds the four edges of the rectangular plate member. A grip 29, better illustrated in FIG. 1, in the form of a triangular channel is provided in the central portion of the rear flange 31. The grip 29 has a snapping member 33 (FIG. 2) for sealing the cover 25 over the upright container 1 (as will be shown later).

The cover 25 has a pair of wings 35, 37 which outwardly project from flange portion 39 (FIG. 1) and are angularly downwardly directed as shown in the drawings. Each wing 35, 37 has a corresponding stud 41, 43 which projects with the outer face of the wing and which will be part of the hinging mechanism which will be defined later.

Referring again to the upright container 1, along and below the front edge 45 there is provided a pair of projecting tabs 47 each having an orifice 49 formed therein, the receive a stud 41, 43. It is understood that the the tabs 47 must mesh with corresponding wings 35, 37 and that the studs 41, 43 should be engaged in orifices 49 to constitute the hinging mechanism enabling to open or close the cover over the upright container 1 as shown in FIG. 1.

Figure 3:
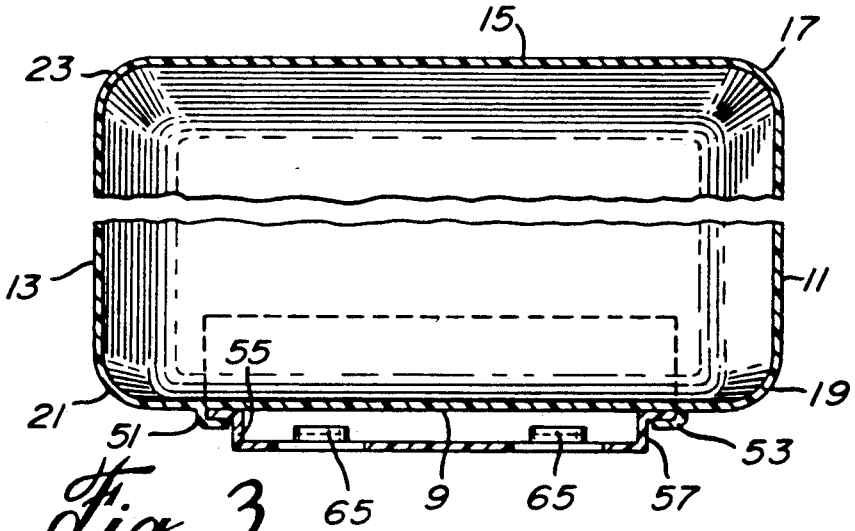
FIG. 3 is a cross-section view taken along line 3—3 of FIG. 2.

Finally, to engage the upright container on the holder 3 the latter has a pair of vertical slides 51, 53 each being L-shaped in cross-section as particularly shown in FIG. 3 of the drawings.

Figures 2, 5:
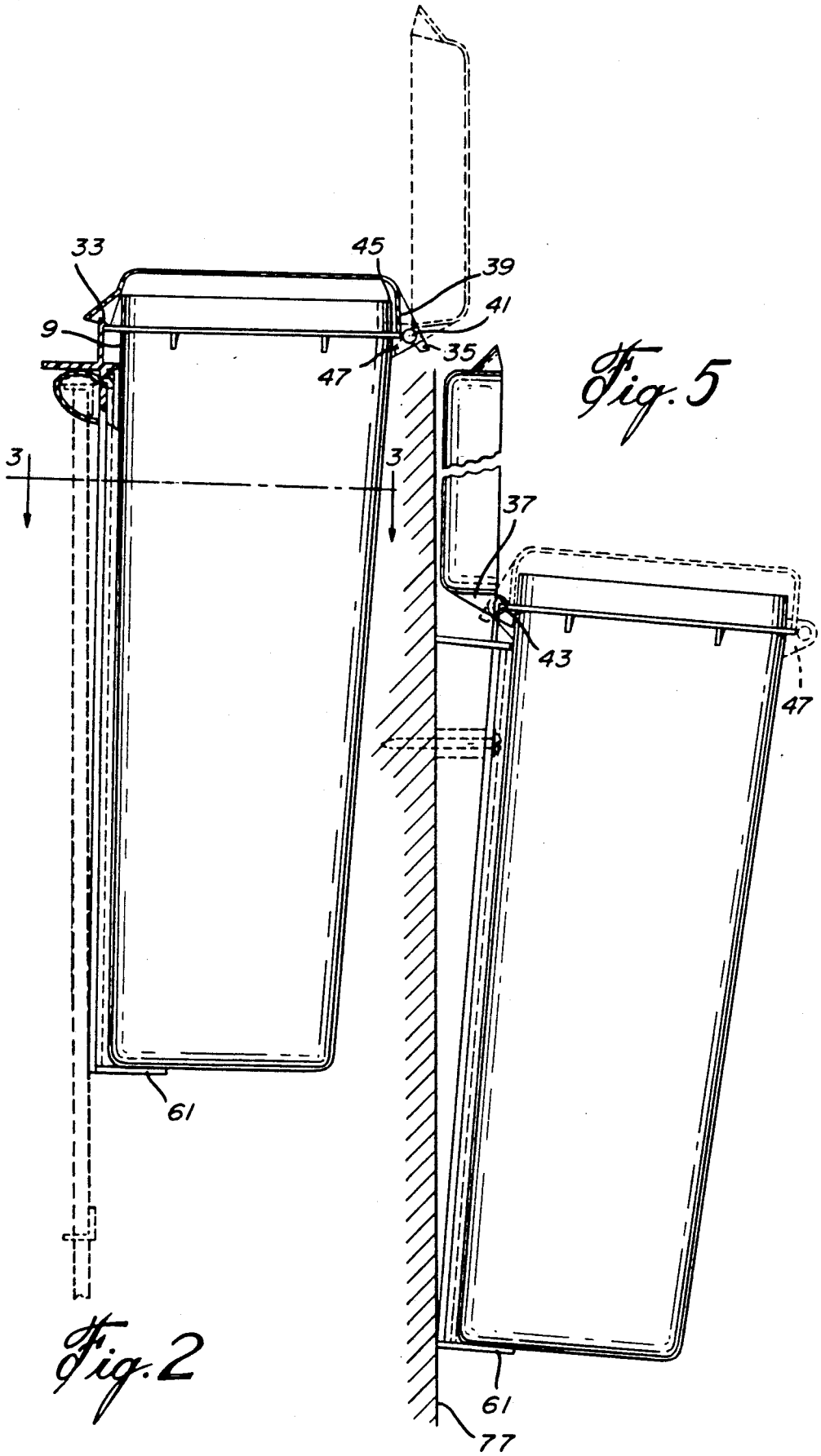
FIG. 2 is a side view of the device illustrated in FIG. 1, a portion of the strap, cover and top plate being shown in cross-section for better illustration.
FIG. 5 is a side view showing the mounting of the combination holder and receptacle against a vertical wall.

Turning now to the holder 3, the latter will now be described with particular reference to FIGS. 1 and 4. It consists of a rectangular member where the lateral edges are formed with L-shaped outwardly projecting flanges 55, 57. At the upper edge of the rectangular member there is a top plate 59 which projects outwardly and at right angle as shown in FIGS. 2 and 3. At the lower edge, there is a base plate 61 (FIG. 2) which projects inwardly and at right angle.

Figure 4:
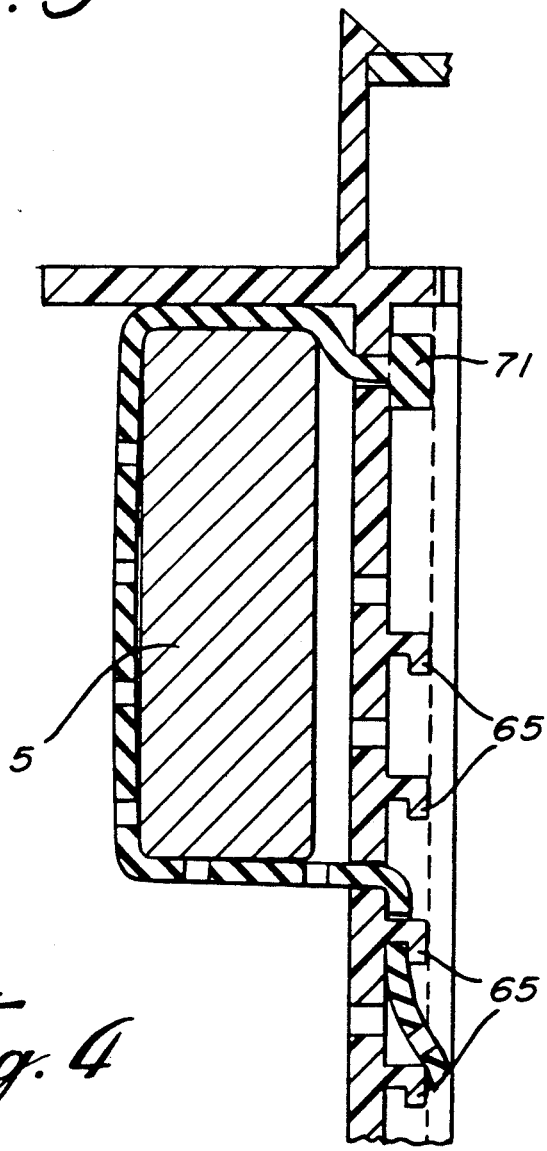
FIG. 4 is a vertical cross-section view showing the mounting of the holder over a handrail.

In the upper part of the holder 3, there are provided two columns of horizontal slots 63 which are spaced from one another and are regularly distributed as shown in FIGS. 1 and 4. On the opposite face of the holder 3, below each of the second to the last slots there is a locking member 65 which is L-shaped in cross-section and the purpose of which will be discussed in detail hereinbelow.

The combination is completed by a pair of straps 67, 69 (FIGS. 1 and 4). Each strap has an arrester 71 at its inner end and a number of transverse channels 73 which are distributed as shown towards the outer end of the strap.

The installation of the combination illustrated is straight forward. Straps 67 and 69 are inserted through the uppermost slot 63 of each column of slots, until the arrester 71 is held against the inner face of the holder. The strap is thereafter wound around handrail 5 and its outer end is inserted through an appropriate slot 63 appearing immediately below handrail 5. A channel 73 is thereafter engaged over the closest locking member 65 to firmly engage the holder 3 over the handrail 5. Then the container is mounted on the holder by engaging the vertical slides 51, 53 over the flanges 55, 57. The combination can also be mounted against a vertical wall 7 as shown in FIG. 5, In this case, it is necessary to provide an additional pair of tabs 79 and to reverse the mounting of the cover 25. The holder 1 can be fixed to the wall by any known means such as illustrated at 81, which is a bolting mechanism.

We claim:

1. A combination of a receptacle and a holder for said receptacle, said combination to be mounted on a horizontal support and also capable of being fixed against a vertical wall, said receptacle comprising an upright container having a rear portion formed with a pair of slide means, and a cover hingedly operable at top of said upright container to open at least rearwardly therefrom, said holder comprising a rectangular member, outwardly projecting flange means formed along lateral edges of said rectangular member, a top plate extending at least partly at upper edge of said rectangular member and projecting outwardly therefrom substantially at right angle, a base plate extending at least partly along bottom edge of said rectangular member and projecting inwardly therefrom substantially at right angle, a plurality of horizontal slots formed in said rectangular member and arranged to provide at least one column of vertically distributed spaced slots, a plurality of locking means provided in front face of said rectangular members each distributed opposite and in vicinity of said slots, at least one strap provided with an arrester at an inner end thereof and having a plurality of means engageable with said locking means, said engageable means distributed toward outer end of said strap, said strap to extend through an uppermost slot while being held by said arrester, to extend over said horizontal support, and a selected engageable means hooked over said locking means to retain said holder against said horizontal support, so that to mount said combination, said holder is fixed to said support by means of said strap and said receptacle is affixed to said holder by engaging said sliding means over said flange means.

2. The combination as claimed in claim 1, wherein said upright container has hinging means formed along upper front and rear edges thereof enabling to mount said cover for opening toward said front edge when said holder is mounted over a horizontal support and toward said rear edge when said holder is mounted against a vertical wall by fixing said holder against said wall.

3. The combination as claimed in claim 1, wherein said upright container comprises a first pair of outwardly projecting tabs formed along front edge of said upright container, each tab being formed with an opening, a pair of wings outwardly projecting from an edge of said cover and meshing with said first pair of outwardly projecting tabs, a stud insertable in one said opening and projecting from an outer face of each said wing, said tabs and said wings when engaged together defining a hinge mechanism for said cover.

4. The combination as claimed in claim 3, comprising a second pair of outwardly projecting tabs, each also formed with an opening, formed along rear edge of said upright container, said second pair of outwardly projecting tabs capable of engagement with said wings and studs after having reversed said cover for opening same toward the rear edge of said upright container, when said holder has been mounted against a vertical wall by fixing said holder against said wall.

5. The combination as claimed in claim 1, which comprises two columns of said vertically distributed spaced horizontal slots, two said straps and two columns of vertically distributed spaced hooks constituting said locking means, said engageable means comprising transverse channels formed along said straps, one said channel engaging over a selected hook after having successfully passed said strap through said first slot over said horizontal support and finally through a selected second slot.

6. The combination as claimed in claim 1, wherein the cover is formed with a peripheral flange to surround upper edges of said upright container when closed thereover, a grip member formed along rear peripheral flange of said cover and having a snapping member, said top plate having a flat member vertically projecting therefrom for engagement with said snapping member and sealing of said cover over said upright container.

7. A holder for a receptacle, said holder to be mounted on a horizontal support and also capable of being fixed against a vertical wall, said holder comprising a rectangular member, outwardly projecting flange means formed along lateral edges of said rectangular member, a top plate extending at least partly along upper edge of said rectangular member and projecting in one direction substantially at right angle, a base plate extending at least partly along bottom edge of said rectangular member and projecting in opposite direction substantially at right angle, a plurality of horizontal slots formed in said rectangular member and arranged to provide at least one column of vertically distributed spaced slots, a plurality of locking means provided in front face of said rectangular members each distributed opposite and in an arrester at an inner end thereof and having a plurality of means engageable with said locking means, said engageable means distributed toward outer end of said strap, said strap to extend through an uppermost slot while being held by said arrester, to extend over said horizontal support, and a selected engageable means hooked over said locking means to retain said holder against said horizontal support.

* * * * *